US007204024B2

(12) United States Patent
Hubbs

(10) Patent No.: US 7,204,024 B2
(45) Date of Patent: Apr. 17, 2007

(54) TRACK AND PUNCH SMR MARKING DEVICE

(75) Inventor: William O. Hubbs, Cedar Hill, MO (US)

(73) Assignee: Hubbs Machine & Manufacturing Co. Pro Corp., Cedar Hill, MO (US)

( * ) Notice: Subject to any disclaimer, the term of this patent is extended or adjusted under 35 U.S.C. 154(b) by 0 days.

(21) Appl. No.: 11/352,840

(22) Filed: Feb. 13, 2006

(65) Prior Publication Data

US 2006/0191394 A1 Aug. 31, 2006

Related U.S. Application Data

(63) Continuation of application No. 10/640,285, filed on Aug. 13, 2003, now abandoned.

(60) Provisional application No. 60/404,546, filed on Aug. 20, 2002.

(51) Int. Cl.
*B26F 1/00* (2006.01)

(52) U.S. Cl. ..... 30/367; 30/358; 30/361; 33/677

(58) Field of Classification Search ..... 83/588, 83/627, 638, 684, 861, 866, 682, 522.15, 83/522.11, 522.13; 30/366, 367, 358, 361; 33/293, 666, 679, 677, 286, 627, 644, 645, 33/574; 356/256; 359/831, 896
See application file for complete search history.

(56) References Cited

U.S. PATENT DOCUMENTS 2,730,811 A 1/1956 Gouldsmith, Jr.
2,934,829 A * 5/1960 Bohn ..... 33/677
3,117,480 A * 1/1964 Peddinghaus ..... 83/520
4,262,426 A * 4/1981 Miyazaki ..... 359/368
4,521,968 A 6/1985 Wiltermood et al.
4,964,218 A * 10/1990 Morghen ..... 33/293
4,974,324 A * 12/1990 Ohkubo ..... 30/366
5,675,899 A 10/1997 Webb
5,784,793 A 7/1998 Rando
5,829,147 A 11/1998 Kousek et al.
5,862,727 A 1/1999 Kelly
5,894,675 A 4/1999 Cericola
5,918,523 A 7/1999 Cutter
5,946,127 A * 8/1999 Nagata ..... 359/280
6,299,122 B1 * 10/2001 Bame ..... 248/466

* cited by examiner

*Primary Examiner*—Kenneth E. Peterson
*Assistant Examiner*—Phong Nguyen
(74) *Attorney, Agent, or Firm*—Paul M. Denk

(57) ABSTRACT

A track and punch SMR marking device, including a base, the base mounts for adjustment an SMR (spherically mounted retro-reflector), which in cooperation with a laser tracker beam locates the device precisely over an area where a punch mark is to be made, the base includes an upright sleeve, for holding a striker shaft, the striker shaft, at its lower end, includes a bevel, mating with the inclined surface of a cross slide, the cross slide, when it is urged forwardly, depresses a punch forcing it downwardly so as to provide a punch point or indentation upon the component to be worked.

9 Claims, 3 Drawing Sheets

TRACK AND PUNCH SMR MARKING DEVICE

CROSS REFERENCE TO RELATED APPLICATION

Figure 1:
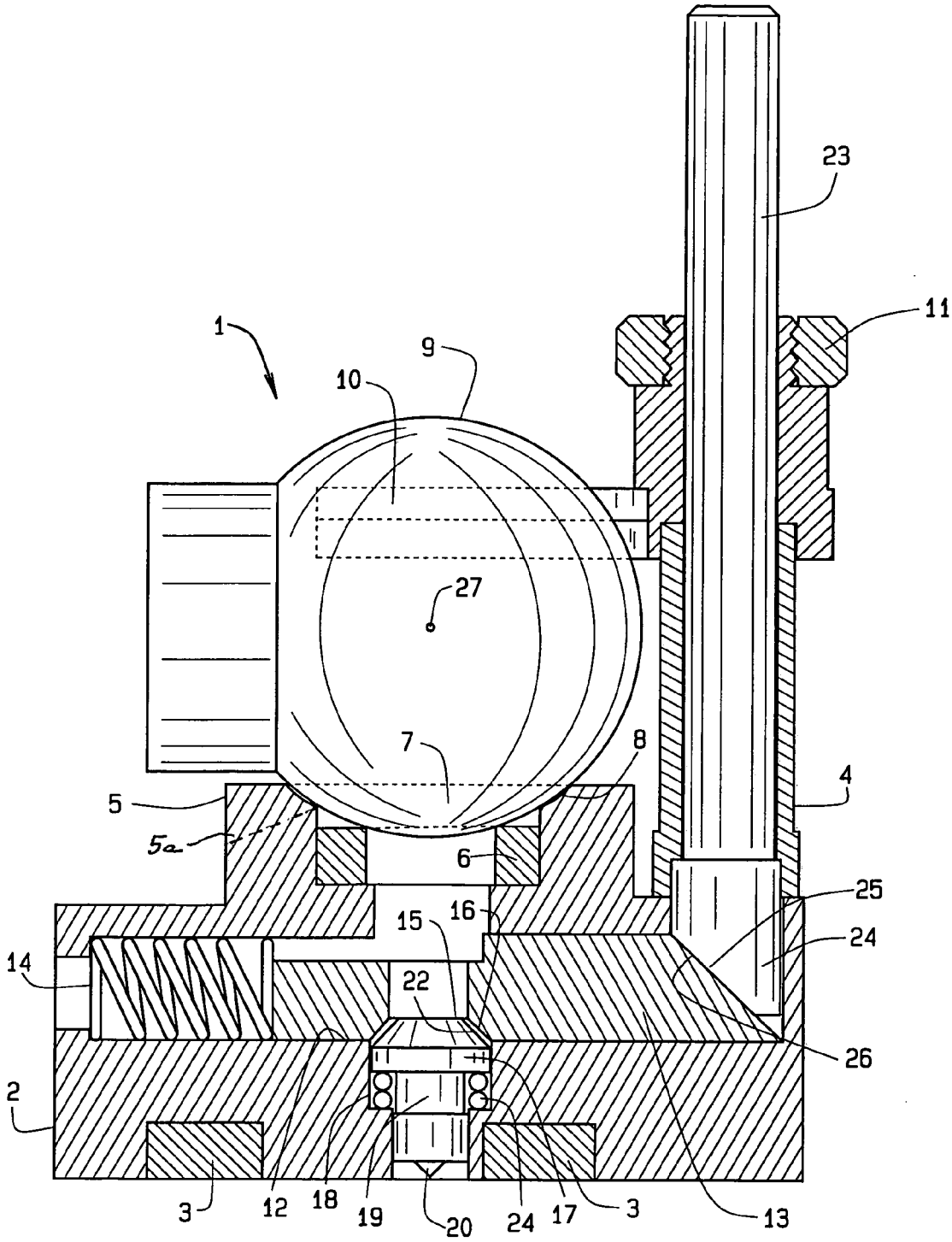

This continuation patent application claims priority to the non-provisional patent application having Ser. No. 10/640,285, which was filed on Aug. 13, 2003, now abandoned which claims priority to the provisional patent application having Ser. No. 60/404,546, which was filed on Aug. 20, 2002.

BACKGROUND OF THE INVENTION

This invention relates generally to a punching device, and more specifically, to a particularly constructed track and punch spherically mounted retro-reflector marking device for use for providing precision marking of a component to be drilled, or the like.

A variety of center punching devices and assemblies have long been available in the art. These devices may undertake configuration of nothing more than a punch, that can be lowered into a marking position, provide a slight indentation into the part to be worked, such as by drilling, etc., but obviously precision is not the end result, nor is obtained, with these types of earlier devices. This day and age, it is not unusual to require the marking, and eventual drilling or other work to be performed upon a component, within tolerances that may be as tight as ten thousandths of an inch. Under the circumstances, it is required that precision marking be initially conducted, even under precise laser tracker positioning instrumentation, to assure that such tolerances can be met, when precision machining is undertaken.

Examples of earlier type of punching assemblies can be seen in the Goldsmith, Jr., U.S. Pat. No. 2,730,811 that shows a center punching assembly. It includes a spring biased punch, which is normally elevated, as can be noted, such that when the instrument is positioned approximately where a punch is to be made, incorporates a magnifying lens, to provide for some degree of perfection in the observance as to where the punch is to be made, in order to furnish an increased degree of accuracy, as noted.

The patent to Wiltermood, et al, U.S. Pat. No. 4,521,968, shows an apparatus for mapping the inner surface of a cylinder utilizing a laser to align a spider disposed within the cylindrical surface. This device shows the usage of a laser means, for gaging the precise locations for mapping the internal areas of a cylinder, as can be noted, but does not include any type of technology for use for scribing or punching a demarcation point, where a further operation is to be performed, such as drilling, etc.

The patent to Webb, U.S. Pat. No. 5,675,899, shows a rotary saw with laser beam alignment. This device is pertinent from the standpoint of showing a laser, for providing a guideline for cutting with a rotary saw, as can be noted. Thus, the use of an instrument, with the laser, to provide for some degree of precision in usage of the instrument, is generally disclosed in this prior art.

The patent to Rando, U.S. Pat. No. 5,784,793, discloses a marking template for construction lasers. This device also uses lasers, for providing a marking at a construction site, but the equipment used, and its method of operation, is quite different from the current invention. Rando produces its own discrete results. The use of lasers with a tool, on the other hand, is noted in this patent.

The patent to Kousek, et al, U.S. Pat. No. 5,829,147, shows an apparatus for applying marks to surfaces. Once again, this is a device for marking surfaces, at constructions sites, such as upon walls and ceilings, through the use of a photo electric detector device. This device broadly uses lasers for marking purposes, but it is of a different construction, and for a different use, than the instrument under consideration in this application.

The patent to Kelly, U.S. Pat. No. 5,862,727, shows a laser arbor. This laser arbor will provide and display a cutting line on a work piece, apparently through the use of a laser.

The patent to Cericola, U.S. Pat. No. 5,894,675, shows a combination tool. This combination tool is for use for measuring, eveling, squaring, and plumbing operations. But, it does not appear to be used for facilitating the highly accurate usage of a punch, as for drilling and related purposes.

Finally, the patent to Cutter, U.S. Pat. No. 5,918,523, discloses a system for guiding a cutting tool. Once again, this device uses a laser beam, for providing guidance to the cut line to be made upon a work part, and is for use in conjunction with a cutting tool, as defined. Hence, the patent is pertinent from the standpoint of showing the utilization of lasers in combination with an item of machinery, such as a cutting tool, but that is the extent of its similarity to the device of this current invention.

It does not appear, from the prior art as known, that any one has provided a structured device that incorporates a spherically mounted retro-reflector or related device, and utilizing the laser beam to provide for its precise setting during usage.

SUMMARY OF THE INVENTION

This invention related principally to a track and punch device, utilizing a spherically mounted retro-reflector, that is mounted in a nest, for providing very precise punching upon a part to be worked, so as to add to the high accuracy of any machining operation performed.

This invention contemplates the formation of a punching device, that can be used to provide a very tiny punch spot, with a particular degree of precision, on a metal or other surface to be worked, to provide guidance to a drill, or other instrument, when operated. The device is very precise in its setting, and operates in conjunction with a laser tracker type of instrumentation, that provides for the very precise setting of the punch, before the punch is activated and scribes a punch point.

For example, if a large metal surface needs a hole drilled at a very precise location, even at tolerances previously reviewed, a laser tracker will be set up, to provide for a precise location with respect to where the hole is to be drilled or reference mark is to be made. Then, this instrumentation, and its SMR (spherically mounted retro-reflector), is set up so that the laser beam enters the SMR, is reflected by its polished aluminum or silver surface internally of it, and when the beam is directed back towards the emitting instrument, at a precise setting, then the operator will know that this punch is set at the precise position for providing the required punch mark. When that occurs, then the operator simply needs to hammer upon the striker, at its upper end, which pushes the cross slide laterally, as the cross slide moves to the side, it compresses the punch downwardly, against the O rings, allowing its pointed bottom end to scribe a point upon the surface, where the drilling is to take place. The slide has a spring at one end, and will force the cross slide back towards its static position, once the punch is made, and the point scribed. Various magnets are also provided upon the device in order to afford its retention, to the surface, particularly metal, to which the device is applied, in preparation for its laser set up, and punching of the scribed point.

The instrumentation includes a base, having the embedded magnets or other retention means therein, the base incorporates a centralized aperture, through which a punch locates, when actuated. A cross slide is provided within the base, spring biased to a steady state condition, but when the cross slide is forced by means of hitting upon a striker, it forces the punch downwardly, to provide a point where further machining is to take place, such as a drilling operation.

The base includes an upright sleeve, for holding the striker shaft, and a clamp mounts upon the sleeve, held in position by means of a retainer nut, or securing a spherically mounted retro-reflector in place, that can be manipulated, to any angle, for cooperating with a laser beam, such as with a surveying instrument, that provides for the precise setting of the device, the location of its punch point at a very precise position where a mark must be embedded into the material that is subsequently to be machined as by drilling, or the like.

It is, therefore, the principal object of this invention to provide a highly precise punching device that cooperates with the laser tracker, and a spherically mounted retro-reflector, for demarcating a point upon any part to be further worked, as by drilling, or the like.

Still another object of this invention is to provide a conveniently and compact type of marking device, readily disposing a striker for manipulating to furnish a punch point on a component to be further worked.

Still another object of this invention is to provide means for mounting of a spherically mounted retro-reflector to a punching device, and through cooperating with guidance means, such as a laser tracker, affords its precise setting for marking a component to be further machined.

Yet another object of this invention is to provide a punching device, that automatically resets itself for further usage, once a scribed or punched mark has been delineated within a component to be worked.

Still another object of this invention is to provide a clamping means for use in conjunction with a punching device for securing an SMR in place.

Yet another object of this invention is to provide means for retention of an SMR in place, through the combination of a clamp, and a positioning magnet, provided upon the punching device.

These and other objects may become more apparent to those skilled in the art upon the review of the summary of the invention as provided herein, and upon undertaking a study of the description of the preferred embodiment, in view of the drawings.

BRIEF DESCRIPTIONS OF THE DRAWINGS

Figure 2:
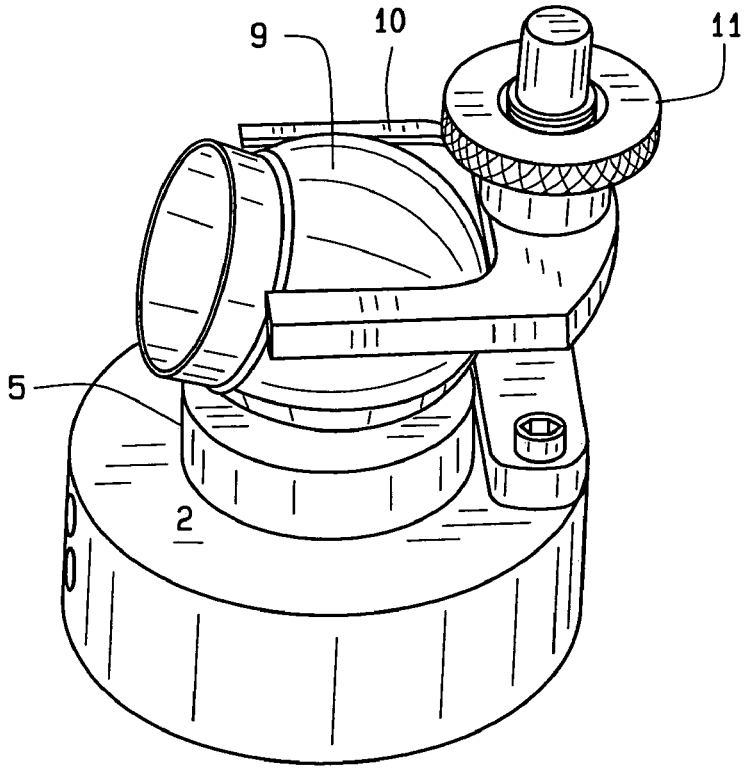
Figure 3:
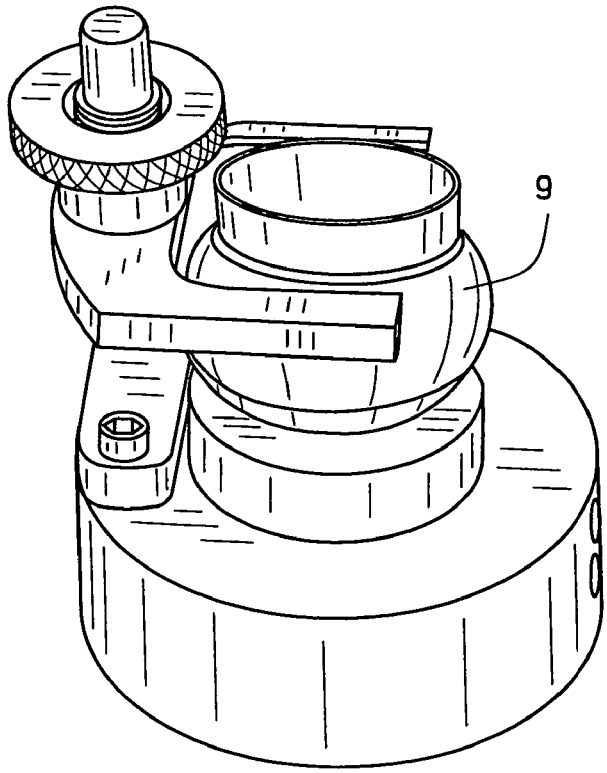
Figure 4:
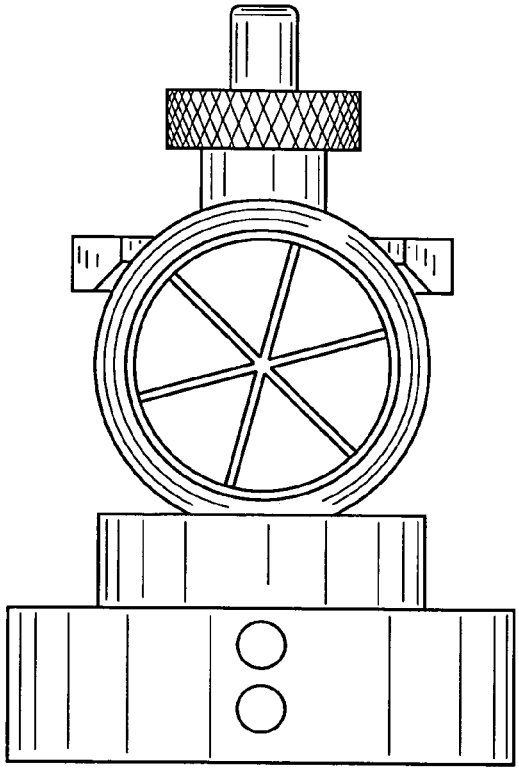
Figure 4:
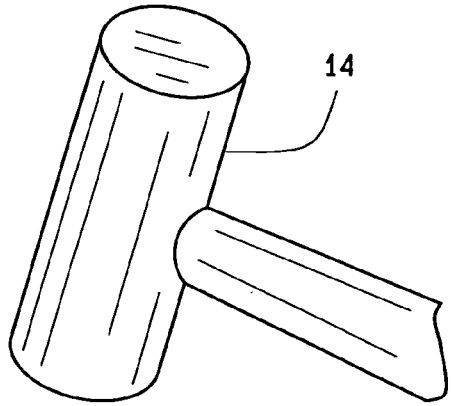

In referring to the drawings, FIG. 1 provides a side schematic view of the SMR punch device of this invention;

FIG. 2 provides an oblique view of the punch device of this invention;

FIG. 3 provides an oblique opposite side view of the punch device of this invention;

FIG. 4 provides a front view of the punch device; and

Figure 5:
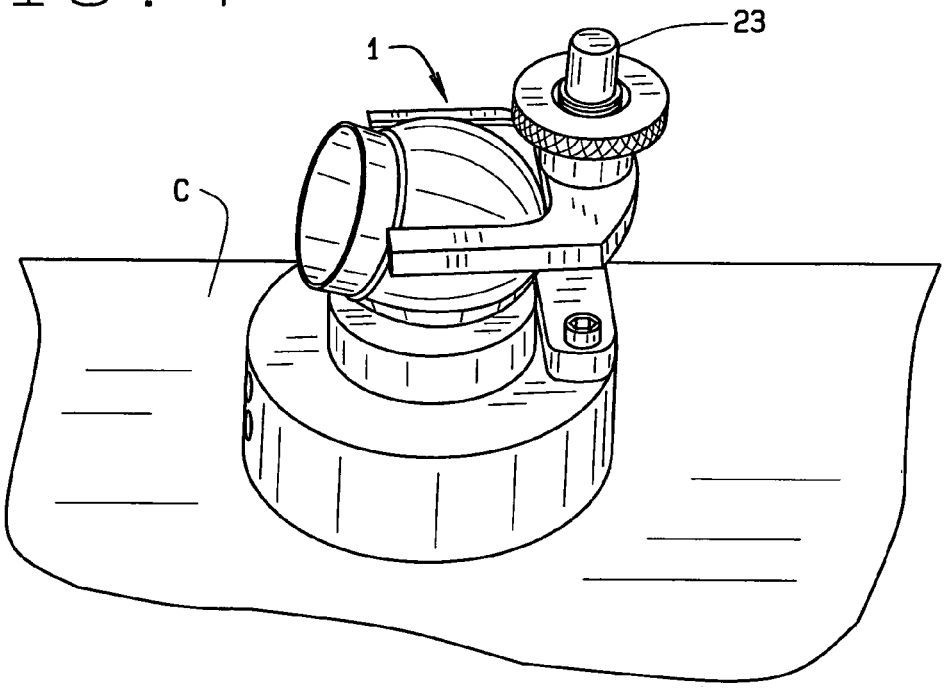

FIG. 5 discloses the punch device, in position, through the use of its laser tracking, in preparation for hitting by an instrument to provide scribing of a point or mark upon components to be further machined.

DESCRIPTION OF THE PREFERRED EMBODIMENT

In referring to the drawings, and in particular FIG. 1, the track and punch SMR marking device of this invention is readily disclosed, as at 1. The structure includes a base member 2 which has embedded therein one or more magnets 3 which are designed for temporarily affixing the device to the surface to be marked, and if it is of a metallic substance, the magnets aid in holding the set device in place. Extending upwardly is an attached sleeve 4, as can be noted, extending upwardly from the approximate back end of the base 2.

The base includes an upwardly extending integral portion 5, which includes a further magnet 6 provided within a counterbore, and has an opening 7 furnishing slightly beveled edges 8, around its perimeter, and it is designed to provide for sliding seating a spherically mounted retro-reflector 9 as can be noted. A magnet retainer clip **6*a* provides for retention of the magnet in place. In addition, negative rotation notch 5*a*, provided at the front of the base portion 5, aids in the retention of the retro-reflector 9 in place, during adjustment, and when fixed into position and allows rotation of the SMR below horizontally. In able to arrange the SMR, or its frontal opening, outwardly within the contours of the notch 5*a*, such allows for reception of a laser beam which may project upwardly from a lower position, or upwards from upon the ground. Such a retro-reflector incorporates optics and is used in conjunction with a laser tracking instrument, such that when a laser beam enters into the reflector, and the reflector is at a precise precision where it is supposed to be arranged, the laser beam will be reflected back on itself, to indicate that a perfect setting has been made for the punch device. A clamp arm 10 is mounted upon the sleeve 4, and is held in position by means of a retainer nut 11**. The clamp arm is designed to provide for embracing the upper surface of the SMR, to reasonably affix it in position, once it has been installed for usage. Then, the retainer nut can be tightened, once a fixed setting has been achieved, to retain that precise positioning. Or, the retainer nut can be loosened, so as to allow for the SMR to be readjusted in its optical setting. Such an SMR can be obtained from any of the following companies:

Automated Precision, Inc., of Rockville, Md.; Leica Geosystems, Inc., of Norcrosse, Ga.; Faro Technologies, Inc., of Lake Mary, Fla.; and Plx, Inc., of Deer Park, N.Y.

Provided through a channel 12 furnished in the base is a cross slide 13, which is spring biased, at its front end, by means of the spring 14. At the underside of the cross slide is provided a cut out section 15, which is beveled, as noted at 16, and located within this cut out portion of the cross light is the upper end of the punch 17, which sits within an opening 18 formed of the base. Extending integrally downwardly from the member 17 is an integral shank 19, and projecting from its bottom is the punch point 20 as can be noted. Two O-Rings 21 normally biases the punch upwardly, as when not in use. But, when the cross slide slides to the front, its bevel 16 engages the corresponding beveled surface 22 of the upper part of the punch, and in this manner forces the punch downwardly, so that its punch point 20 can provide a mark or indentation upon the surface to be worked.

Extending upwardly within the sleeve 4, and through the retainer nut 11, is a vertically arranged striker 23. The bottom end of the striker is connected with a enlarged base 24, which is inclined, as at 25, and which engages a corresponding incline surface 26 provided at the back edge of the cross light 13, as can be noted. Thus, when pressure or a hammer is impaled upon the striker 23, at its upper end, the striker rapidly descends, its beveled surface 25 rides upon the beveled surface 26 of the cross slide, thereby forcing the cross slide rapidly towards the front of the base 2. Hence, as this occurs, the inclined surface 26 of the cross slide encounters the beveled edge 22 of the punch, forcing it downward, so that its punch point 20 can provide for a marker indentation upon the component to be worked.

It can also be noted that the SMR, when set upon the device, appears to be perfectly aligned, at its mid-point, approximately at the location 27, above the exact lower point of the punch point 20, as can be noted. This is what achieves the close tolerence alignment of the punch, over the location to be indented, for component working. In addition, the precise positioning of the SMR, as previously commented, is done through the use of laser telemetry, and precision location through the use of laser tracker instrumentation, such as well know in the surveying art.

As can be noted in FIG. 2, an overall view of the track and punch SMR marking device of this invention is readily disclosed. The SMR 9 is retained for safety by means of the clamp 10 in position, and once its angulation is established, as can be noted, it can be protected from possibly dislodging from the magnetic nest by means of tightening of the retainer nut 11, as noted. All of these instrumentations are fixed in position upon the base 2, and its integrally upwardly extending boss 5, as previously explained.

The tracking and punching device is also shown in FIG. 3, where the SMR 9 is angulated directly upwardly, during its usage and application.

FIG. 4 provides a front view of the device, showing its various operating components, as previously reviewed. Finally, FIG. 5 shows the device, when set in position upon a component, as at C, to be worked, and being hit by a hammer or mallet H, where it will force its punch point 20 to furnish an indentation upon the component C, at the precise location, as established by the SMR, and its accompanying laser tracker, to provide an indication where further working, such as drilling, shall take place upon the said component, during its fabrication. These are examples as to how the device is applied, to furnish precision marking upon a component to be worked, to maintain close tolerances as required in precision machining this day and age.

Variations or modifications to the subject matter of this invention may occur to those skilled in the art upon review of the disclosure as provided herein. Such variations, if within the spirit of this development, are intended to be encompassed within the scope of the invention as defined. The description of the preferred embodiment, and the schematic showing the illustration of the device of this invention, are set forth for illustrative purposes only.

The invention claimed is:

1. A track and punch device for a laser tracker in combination with a SMR for precision setting before the punch is activated to scribe a point upon a surface to be machined, said track and punch device including a base, said base provided for locating upon a surface to be machined, the base having an upright portion extending upwardly therefrom, said upright portion having an upper surface to provide a seat, said seat provided for setting of the SMR, whereby upon laser tracker cooperation with the SMR providing for a precise setting of the track and punch device in preparation for scribing a punch indentation upon the surface of the part to be machined;

a striker operatively associated and mounted to the base, the base having an opening therethrough extending down to an open bottom of the base, said striker provided within said opening of the base for reciprocal movement therein, said striker cooperating with the punch point such that upon impacted activation of the striker, forcing the punch point downwardly to inscribe a precise indentation upon the part to be machined, and the center of the SMR being precisely aligned vertically over the striker punch point to provide precision indentation upon the part to be machined;

a second opening provided laterally within the base, the second opening communicating with the first opening in the base, said second opening being approximately perpendicular with respect to said first opening, a cross slide provided within said second opening, said cross slide at a first end being contacted by the striker, and said cross slide having a second end, said cross slide having a bottom surface communicating with and cooperating with the punch point, such that when said cross slide moves laterally, it forces the punch point downwardly for inscribing an indentation upon the part to be machined, said base includes a striker sleeve extending upwardly therefrom, said striker sleeve having a channel provided therethrough and in which the striker locates for reciprocal movement, said striker engages said cross slide with a downward impacted movement of the striker, the cross slide is forced laterally, and further forces the punch point downwardly for providing an indentation.

2. The track and punch device of claim 1 wherein said punch point is spring biased upwardly within said base to withdraw from the indented surface after the striker has been impacted.

3. The track and punch device of claim 1, and including a spring provided within the lateral opening of the base, said spring biasing against the second end of said cross slide to urge it to its non-operative position thereby allowing the punch point to return from its indenting position.

4. The spherically mounted retro-reflector and base of claim 1, wherein said upwardly extending integral portion of the base has a notch therein, and for reception of part of the spherically mounted retro-reflector to allow for its adjustment for reception of a laser beam directed from above and into a downward direction.

5. A track and punch device for laser tracker in combination with a SMR for precision setting before the punch is activated to scribe a point upon a surface to be machined, said track and punch device including a base, said base provided for locating upon a surface to be machined, the base having an upright portion extending upwardly therefrom, said portion having an upper surface to provide a seat, said seat provided for setting of the SMR, whereby upon laser tracker cooperation with the SMR providing for a precise setting of the punch device in preparation for scribing a punch point indentation upon the surface of the part to be machined;

a striker operatively associated and mounted to the base, the base having an upright sleeve mounted to the base and having an opening therethrough extending down to an open bottom of said base, said striker provided within said opening of the base for reciprocal movement therein, said striker cooperating with the punch point such that upon impacted activation of the striker, forcing the punch point downwardly to inscribe a precise indentation upon the part to be machined, and the center of the SMR being precisely aligned vertically over the striker punch point to provide precision indentation upon the part to be machined;

said punch point is spring biased upwardly within said base to withdraw from the indented surface after the striker has been impacted;

a second opening provided laterally within the base, the second opening communicating with the sleeve opening in said base, said second opening being approximately perpendicular with respect to said first opening, a cross slide provided within said second opening, said cross slide at a first end being contacted by the striker, and said cross slide having a second end, said cross slide having a bottom surface communicating with and cooperating with the punch point, such that when said cross slide moves laterally, it forces the punch point downwardly for inscribing an indentation upon the part to be machined;

said striker engages said cross slide with a downward impacted movement of the striker, the cross slide is forced laterally, and further forces the punch point downwardly for providing an indentation;

a spring provided within the lateral opening of the base, said spring biasing against the second end of said cross slide to urge it to its non-operative position thereby allowing the punch point to return from its indenting position;

said base includes a striker sleeve extending upwardly therefrom, said striker upright sleeve having said opening provided therethrough and in which the striker locates for reciprocal movement; and wherein said striker sleeve includes an arm, said arm provided for clamping the SMR into position for providing a precise setting to the punch point in preparation for its indenting of a part to be machined.

6. The track and punch device of claim 5 wherein said SMR is adjustable in its positioning between the clamp and the sleeve seat, to provide for its manipulation and setting in cooperation with any laser beam directed therein during usage.

7. The track and punch device of claim 6 wherein the means provided for biasing the punch point upwardly includes at least one O-ring.

8. The track and punch device of claim 5 and including the retainer nut threadedly engaging the upper end of the striker sleeve, said retainer nut provided for securing the clamp over the SMR, whereby upon loosening of the retainer nut, the SMR may be freed for adjusting movement, and upon tightening of the retainer nut, the clamp protects the SMR from dislodging from the magnetic nest.

9. A track and punch device for laser tracker in combination with a SMR for precision setting before the punch is activated to scribe a point upon a surface to be machined, said track and punch device including a base, said base provided for locating upon a surface to be machined, the base having an upright portion extending upwardly therefrom, said portion having an upper surface to provide a seat, said seat provided for setting of the SMR, whereby upon laser tracker cooperation with the SMR providing for a precise setting of the punch device in preparation for scribing a punch indentation upon the surface of the part to be machined;

a striker operatively associated and mounted to the base, the base having an upright sleeve mounted to the base and having an opening therethrough extending down to an open bottom of said base, said striker provided within said opening of the base for reciprocal movement therein, said striker cooperating with the punch point such that upon impacted activation of the striker, forcing the punch point downwardly to inscribe a precise indentation upon the part to be machined, and the center of the SMR being precisely aligned vertically over the striker punch point to provide precision indentation upon the part to be machined;

said punch point being spring biased upwardly within said base to withdraw from the dented surface after the striker has been impacted;

a second opening provided laterally within the base, the second opening communicating with the sleeve opening in said base, said second opening being approximately perpendicular with respect to said first opening, a cross slide provided within said second opening, said cross slide at a first end being contacted by the striker, and said cross slide having a second end, said cross slide having a bottom surface communicating with and cooperating with the punch point, such that when said cross slide moves laterally, it forces the punch point downwardly for inscribing an indentation upon the part to be machined;

said striker engages said cross slide with a downward impacted movement of the striker, the cross slide is forced laterally, and further forces the punch point downwardly for providing an indentation;

a spring provided within the lateral opening of the base, said spring biasing against the second end of said cross slide to urge it to its non-operative position thereby allowing the punch point to return from its indenting position;

the first end of the cross slide that contacts the striker is beveled, the bottom of the striker is beveled, whereby upon downward movement of the striker upon its being impacted, forcing the cross slide laterally within the base whereby the punch point inscribes an indentation.

* * * * *